US008158871B2

(12) United States Patent
Mestres et al.

(10) Patent No.: US 8,158,871 B2
(45) Date of Patent: Apr. 17, 2012

(54) AUDIO RECORDING ANALYSIS AND RATING

(75) Inventors: Jordi Janer Mestres, Barcelona (ES); Jordi Bonada Sanjaume, Barcelona (ES); Maarten de Boer, Barcelona (ES); Alex Loscos Mira, Barcelona (ES)

(73) Assignees: Universitat Pompeu Fabra, Barcelona (ES); BMAT Licensing, S.L., Barcelona (ES)

( * ) Notice: Subject to any disclaimer, the term of this patent is extended or adjusted under 35 U.S.C. 154(b) by 0 days.

(21) Appl. No.: 13/068,019

(22) Filed: Apr. 29, 2011

(65) Prior Publication Data

US 2011/0209596 A1 Sep. 1, 2011

Related U.S. Application Data

(63) Continuation of application No. 12/026,977, filed on Feb. 6, 2008, now abandoned.

(51) Int. Cl.
*G10H 1/26* (2006.01)
*G10H 5/00* (2006.01)

(52) U.S. Cl. ..... 84/609; 84/616; 84/649; 84/654

(58) Field of Classification Search ..... None
See application file for complete search history.

(56) References Cited

U.S. PATENT DOCUMENTS 4,365,533 A * 12/1982 Clark et al. ..... 84/682
6,613,971 B1 * 9/2003 Carpenter ..... 84/454
7,268,286 B2 * 9/2007 Carpenter ..... 84/454
7,982,119 B2 * 7/2011 Taub et al. ..... 84/609
2004/0025672 A1 * 2/2004 Carpenter ..... 84/622
2008/0190271 A1 * 8/2008 Taub et al. ..... 84/645
2008/0190272 A1 * 8/2008 Taub et al. ..... 84/645
2009/0193959 A1 * 8/2009 Mestres et al. ..... 84/609
2010/0154619 A1 * 6/2010 Taub et al. ..... 84/616
2010/0212478 A1 * 8/2010 Taub et al. ..... 84/645
2011/0036231 A1 * 2/2011 Nakadai et al. ..... 84/477 R
2011/0209596 A1 * 9/2011 Mestres et al. ..... 84/609
2011/0214554 A1 * 9/2011 Nakadai et al. ..... 84/477 R
2011/0232461 A1 * 9/2011 Taub et al. ..... 84/609

OTHER PUBLICATIONS

Office Action dated Dec. 1, 2009 in U.S. Appl. No. 12/026,977 filed on Feb. 6, 2008.
Office Action dated May 18, 2010 in U.S. Appl. No. 12/026,977 filed on Feb. 6, 2008.
Office Action dated Nov. 29, 2010 in U.S. Appl. No. 12/026,977 filed on Feb. 6, 2008.

* cited by examiner

*Primary Examiner* — Marlon Fletcher
(74) *Attorney, Agent, or Firm* — Lawrence G. Fridman

(57) ABSTRACT

An audio recording is processed and evaluated. A sequence of identified notes corresponding to the audio recording is determined by iteratively identifying potential notes within the audio recording. A rating for the audio recording is determined using a tuning rating and an expression rating. The audio recording includes a recording of at least a portion of a musical composition.

17 Claims, 8 Drawing Sheets

AUDIO RECORDING ANALYSIS AND RATING

This application is a continuation of U.S. patent application Ser. No. 12/026,977 filed Feb. 6, 2008 now abandoned which is currently pending.

BACKGROUND

This description relates to analysis and rating of audio recordings, including vocal recordings of musical compositions.

SUMMARY

This patent application relates generally to audio recording analysis and rating. In some aspects, a method of processing an audio recording includes determining a sequence of identified notes corresponding to the audio recording by iteratively identifying potential notes within the audio recording. The audio recording includes a recording of at least a portion of a musical composition.

Implementations can include one or more of the following.

In the method, the sequence of identified notes corresponding to the audio recording may be determined substantially without using any pre-defined standardized version of the musical composition. In the method, determining the sequence of identified notes may include separating the audio recording into consecutive frames. Determining the sequence of identified notes may also include selecting a mapping of notes from one or more mappings of the potential notes corresponding to the consecutive frames to determine the sequence of identified notes, where each identified note may have a duration of one or more frames of the consecutive frames. In the method, selecting the mapping of notes may include evaluating a likelihood of a potential note of the potential notes being an actual note based on at least one of a duration of the potential note, a variance in fundamental frequency of the potential note, or a stability of the potential note. Selecting the mapping of notes may further include determining one or more likelihood functions for the one or more mappings of the potential notes, the one or more likelihood functions being based on the evaluated likelihood of potential notes in the one or more mappings of the potential notes. Selecting the mapping of notes may also include selecting the likelihood function having a highest value. The method may further include consolidating the selected mapping of notes to group consecutive equivalent notes together within the selected mapping. The method may also include determining a reference tuning frequency for the audio recording.

In some aspects, a method of evaluating an audio recording includes determining a tuning rating for the audio recording. The method also includes determining an expression rating for the audio recording. The method also includes determining a rating for the audio recording using the tuning rating and the expression rating. The audio recording includes a recording of at least a portion of a musical composition.

Implementations can include one or more of the following.

In the method, the rating may be determined substantially without using any pre-defined standardized version of the musical composition. In the method, determining the tuning rating may include receiving descriptive values corresponding to identified notes of the audio recording. The descriptive values for each identified note may include a nominal fundamental frequency value for the identified note and a duration of the identified note. Determining the tuning rating may also include, for each identified note, weighting, by a duration of the identified note, a fundamental frequency deviation between fundamental frequency contour values corresponding to the identified note and a nominal fundamental frequency value for the identified note. Determining the tuning rating may also include summing the weighted fundamental frequency deviations for the identified notes over the identified notes.

In the method, determining the expression rating may include determining a vibrato rating for the audio recording based on a vibrato probability value. Determining the expression rating may also include determining a scoop rating for the audio recording based on a scoop probability value. Determining the expression rating may also include combining the vibrato rating and the scoop rating to determine the expression rating.

In the method, determining the expression rating may include receiving descriptive values corresponding to identified notes of the audio recording. The descriptive values for each identified note may include a vibrato probability value and a scoop probability value. Determining the expression rating may also include determining a vibrato rating for the audio recording based on vibrato probability values for a first set of notes of the identified notes and a proportion of a second set of notes of the identified notes having vibrato probability values above a threshold. Determining the expression rating may also include determining a scoop rating for the audio recording based on an average of scoop probability values for a third set of notes of the identified notes. Determining the expression rating may also include combining the vibrato rating and the scoop rating to determine the expression rating.

The method may also include comparing a descriptive value for the audio recording to a threshold and generating an indication of whether the descriptive value exceeds the threshold. The method may further include multiplying a weighted sum of the tuning rating and the expression rating by the indication to determine the rating. The descriptive value may include at least one of a duration of the audio recording, a number of identified notes of the audio recording; or a range of identified notes of the audio recording.

In some aspects, a method of processing and evaluating an audio recording includes determining a sequence of identified notes corresponding to the audio recording by iteratively identifying potential notes within the audio recording. The method also includes determining a rating for the audio recording using a tuning rating and an expression rating. The audio recording includes a recording of at least a portion of a musical composition.

Implementations can include one or more of the following.

In the method, the sequence of identified notes corresponding to the audio recording may be determined substantially without using any pre-defined standardized version of the musical composition.

In the method, the rating may be determined substantially without using any pre- defined standardized version of the musical composition.

The foregoing methods may be implemented as a computer program product comprised of instructions that are stored on one or more machine-readable media, and that are executable on one or more processing devices. The foregoing methods may be implemented as an apparatus or system that includes one or more processing devices and memory to store executable instructions to implement the method. A graphical user interface may be generated that is configured to provide a user with access to and at least some control over stored executable instructions to implement the method.

The details of one or more examples are set forth in the accompanying drawings and the description below. Further features, aspects, and advantages are apparent in the description, the drawings, and the claims.

DETAILED DESCRIPTION

An audio recording of a musical composition may be analyzed and processed to identify notes within the recording. The audio recording may also by evaluated or rated according to a variety of criteria.

Generally, in analyzing, processing, and evaluating an audio recording, the systems described herein need not, and in numerous implementations does not, refer or make comparison to a static reference such as a previously known musical composition, score, song, or melody. Rating techniques used by the systems herein may also allow for proper rating of improvisations, which may be very useful for casting singers or musicians, for musical skill contests or for video games among others. Rating techniques may be used for educational purposes, such as support material for music students. Rating techniques may also have other uses, such as in music therapy for patients suffering from autism, Alzheimer's, or voice disorders, for example.

Figure 1:
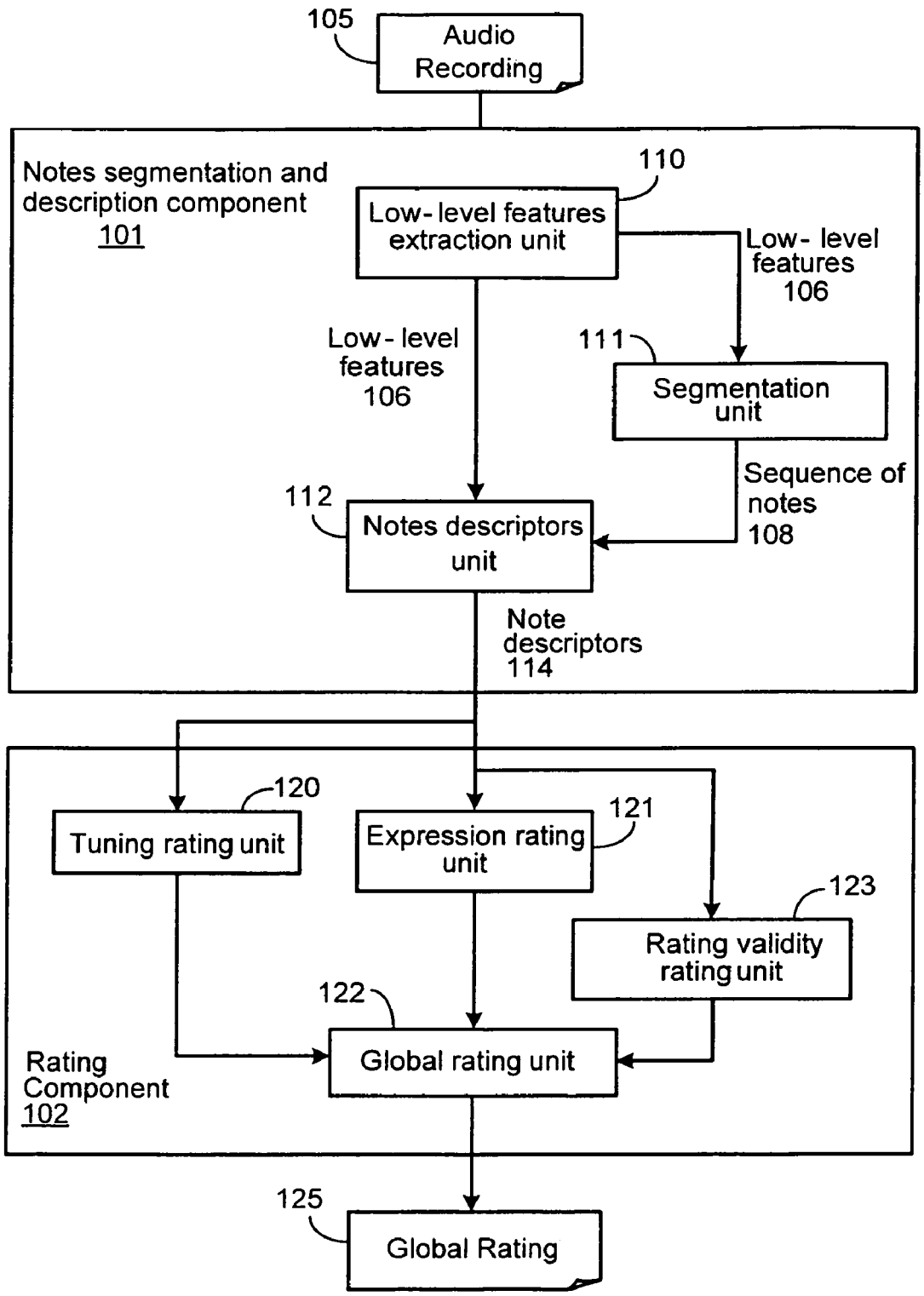
FIG. 1 is a functional block diagram of an audio recording analysis and rating system.

FIG. 1 illustrates a system 100 that may include a note segmentation and description component 101 and a rating component 102. The system 100 may receive an audio recording 105, such as a vocal recording of a musical composition, at the note segmentation and description component 101. A musical composition may be a musical piece, a musical score, a song, a melody, or a rhythm, for example.

The note segmentation and description component 101 may include a low-level features extraction unit 110, which may extract a set of low-level features or descriptors such as features 106 from the audio recording 105, a segmentation unit 111, which may identify and determine a sequence of notes 108 in the audio recording 105, and a note descriptors unit 112, which may associate to each note in the sequence of notes 108 a set of note descriptors 114. The rating component 102 may include a tuning rating unit 120, which may determine a rating for the tuning of, e.g., singing or instrument playing in the audio recording 105, an expression rating unit 121, which may determine a rating for the expressivity of, e.g., singing or instrument playing in the audio recording 105, and a global rating unit 122, which may combine the tuning rating and the expression rating from the tuning rating unit 120 and the expression rating unit 121, respectively, to determine a global rating 125 for, e.g., the singing or instrument playing in the audio recording 105. The rating component 102 may also include a rating validity unit 123, which may be used to check whether the audio recording 105 fulfills a number of conditions that may be used to indicate the reliability of the global rating 125, such as, e.g., the duration of, or the number of notes in, the audio recording 105.

The audio recording 105 may be a recording of a musical composition, such as a musical piece, a musical score, a song, a melody, or a rhythm, or a combination of any of these. The audio recording 105 may be a recording of a human voice singing a musical composition, or a recording of one or more musical instruments (traditional or electronic, for example), or any combination of these. The audio recording 105 may be a monophonic voice (or musical instrument) signal, such that the signal does not include concurrent notes, i.e., more than one note at the same time. For example, the audio recording 105 may be of solo or "a capella" singing or flute playing without accompaniment. Polyphonic signals may be removed with preprocessing to produce a monophonic signal for use by the system 100. Preprocessing may include using a source separation technique for isolating the lead vocal or a soloist from a stereo mix.

The audio recording 105 may be an analog recording in continuous time or a discrete time sampled signal. The audio recording 105 may be uncompressed audio in the pulse-code modulation (PCM) format. The audio recording 105 may be available in a different format from PCM, such as the mp3 audio format or any compressed format for streaming. The audio recording 105 may be converted to PCM format for processing by the system 100. Some details and examples of audio recording and audio signal processing are described in co-pending U.S. patent application No. 11/900,902, titled "Audio Signal Transforming," filed Sep. 13, 2007 and incorporated herein by reference.

The low-level features extraction unit 110 receives the audio recording 105 as an input and may extract a sequence of low-level features 106 from a portion of the audio recording 105 at time intervals (e.g., regular time intervals). These portions from which the features are extracted are referred to as frames. For example, the low-level features extraction unit 100 may select frames of 25 milliseconds at time intervals of 10 milliseconds, although other values may be used. Features may then be selected from the selected frames. The selected frames of the recording 105 may overlap with one another, in order to achieve a higher resolution in the time domain. The total number of frames selected may depend on the length of the audio recording 105 as well as on the time interval chosen.

The low-level features 106 extracted by the low-level features extraction unit 110 may include amplitude contour, fundamental frequency contour, and the Mel-Frequency Cepstral Coefficients. The amplitude contour may correspond to the instantaneous energy of the signal, and may be determined as the mean of the squared values of the samples included in one audio recording 105 frame. The fundamental frequency contour may be determined using time-domain techniques, such as auto-correlation, or frequency domain techniques based on Short-Time Fourier Transform. The fundamental frequency, also referred to as pitch, is the lowest frequency in a harmonic series of a signal. The fundamental frequency contour includes the evolution in time of the fundamental frequency. The Mel-Frequency Cepstral Coefficients (MFCC) characterize the timbre, or spectral characteristics, of a frame of the signal. The MFCC may be determined using any of a variety of methods known in the art. Other techniques for measuring the spectral characteristics of a frame of the signal, such as LPC (Linear Prediction Coding) coefficients, may be used in addition to, or instead of the MFCC.

Other low-level features, such as zero-crossing rate, may be extracted as well. Zero-crossing rate may be defined as the number of times that a signal crosses the zero value within a certain duration. A high zero-crossing rate may indicate noisy sounds, such as in unvoiced frames, that is, frames not having a fundamental frequency.

In this way, values for each of the low-level features 106 may be determined by the low level features extraction unit 110. The number of values may correspond to the number of frames of the audio recording 105 selected from the audio recording 105 as described above.

Figure 2:
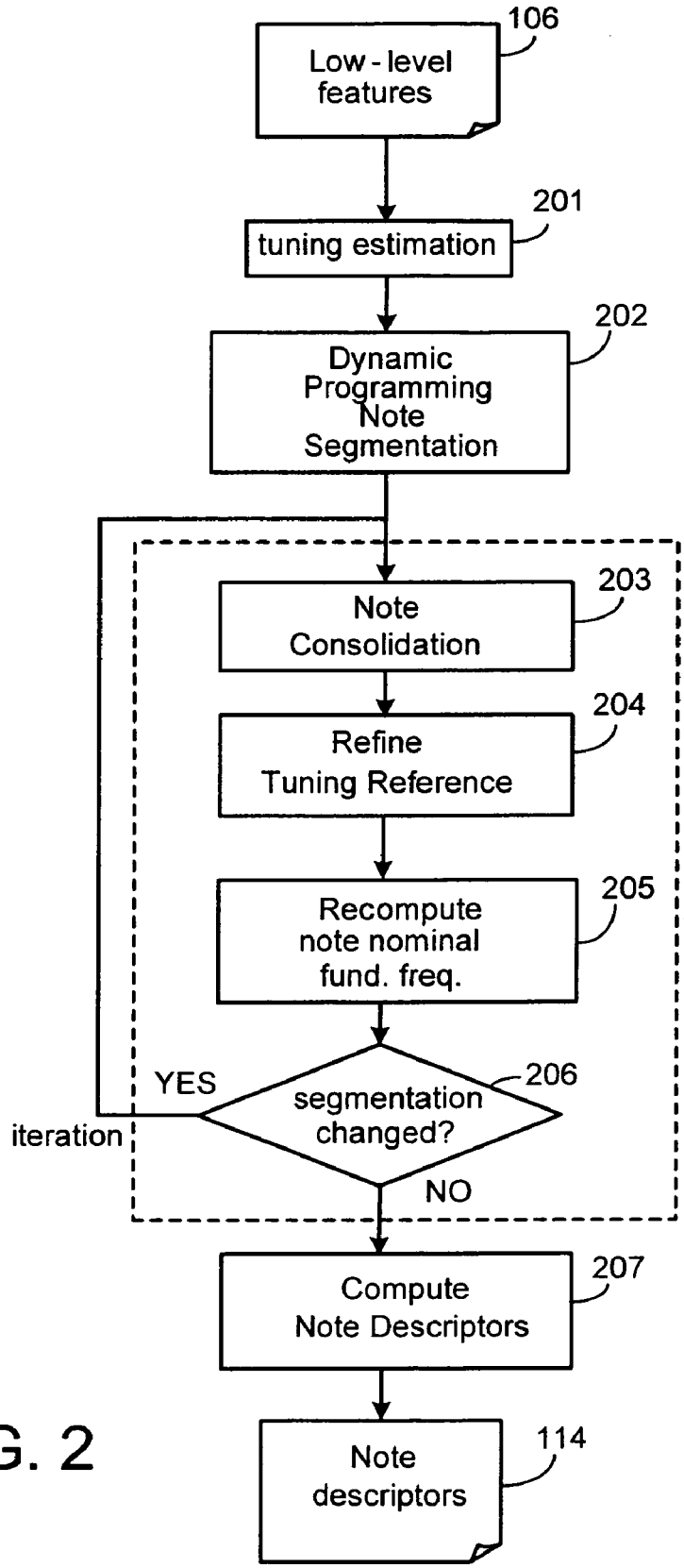
FIG. 2 is a flow chart showing a process.

FIG. 2 is a flowchart of the operations of the note segmentation and description component 101. The purpose of the component 101 is to produce a sequence of notes from the audio recording 105 and provide descriptors corresponding to the notes. The note segmentation and description component 101 may receive, as an input, an audio recording 105. The low-level features extraction unit 110 may extract the low-level features 106, as described above. The input to the segmentation unit 111 may include the low-level features 106 determined by the low-level features extraction unit 110. In particular, low-level features 106, such as amplitude contour, the first derivative of the amplitude contour, fundamental frequency contour, and the MFCC, may be used in the segmentation unit 111. In an implementation, the note segmentation determination may include, as shown in FIG. 2, several stages, including initial estimation of the tuning frequency (201), dynamic programming note segmentation (202), and note consolidation (203). The segmentation unit 111 may make an initial tuning estimation (201), i.e., an initial estimation of a tuning reference frequency as described below. The segmentation unit 111 may perform dynamic programming note segmentation (202), by breaking down the audio recording 105 into short notes from the fundamental frequency contour of the low-level features 106. The segmentation unit 111 may then perform the following iterative process. The segmentation unit 111 may perform note consolidation (203), with short notes from the note segmentation (202) being consolidated into longer notes (203). The segmentation unit 111 may refine the tuning reference frequency (204). The segmentation unit 111 may then redetermine the nominal fundamental frequency (205). The segmentation unit 111 may decide (206) whether the note segmentation (202) used for note consolidation (203) has changed, as e.g., a result of the iterative process. If the note segmentation has changed (at 206), that may mean that the current note segmentation has not converged yet to a preferred path of notes and therefore may be improved or optimized, so the segmentation unit 111 may repeat the iterative process (203, 204, 205, 206). The note segmentation 202 may be included as part of the iterative process of the note segmentation unit 111. If the note segmentation has not changed, that may mean that the current segmentation will not converge further, so processing may proceed from the segmentation unit 111 to the note descriptors unit 112. The note descriptors unit 112 may determine the notes descriptors 114 for every identified note (207).

Thus, the segmentation unit 111 may be used to identify a sequence of notes and silences that, for example, may explain the low-level features 106 determined from the audio recording 105. In an implementation, the estimated sequence of notes may be determined to approximate as closely as possible a note transcription made by a human expert.

1. Initial Estimation of the Tuning Frequency $c_{ref}$ (201)

The tuning frequency is the reference frequency used by the performer, e.g., a singer, to tune the musical composition of the audio recording 105. In analyzing singing voice performances "a capella", i.e., without accompaniment, the tuning reference may generally be unknown and, for example, it may not be assumed that the singer is using, e.g., the Western music standard tuning frequency of 440 Hz, or any other specific frequency, as the tuning reference frequency.

In order to estimate the tuning reference frequency, the segmentation unit 111 may determine a histogram of pitch deviation from the temperate scale. The temperate scale is a scale in which the scale notes are separated by equally tempered tones or semi-tones, tuned to an arbitrary tuning reference of $f_{init}$ Hz. In order to do so, a histogram representing the mapping of the values of the fundamental frequency contour of all frames into a single semitone interval may be determined. In such a histogram, the whole interval of a semitone corresponding to the x axis is divided in a finite number of intervals. Each interval may be called a bin. The number of bins in the histogram is determined by the resolution chosen, since a semitone is a fixed interval. In a mapping of the signal to a single semitone, where the bin number 0 is set at the arbitrary frequency of reference $f_{init}$, e.g. 440 Hz, and the resolution is set to 1 cent unit, i.e., a $100^{th}$ of a semitone, the number of the bin represents the deviation from any note. For example, all frames that have a fundamental frequency that is exactly the reference frequency $f_{init}$ or that have a fundamental frequency that corresponds to the reference frequency $f_{init}$ plus or minus an integer number of semitones, would contribute to bin number 0. Thus, all fundamental frequencies that have a deviation of 1 cent from the exact frequency of reference (i.e., $f_{init}$) would contribute to bin number 1, all fundamental frequencies that have a deviation of 2 cents would contribute to bin number 2, and so on.

With $f$ used to refer to frequencies in Hz units, and C used to refer to frequencies specified in cents units relative to the 440 Hz reference, the relationship between $f$ and c is given in the following equation:

$$c = 1200 \cdot \log_2\left(\frac{f}{440}\right)$$

Figure 3:
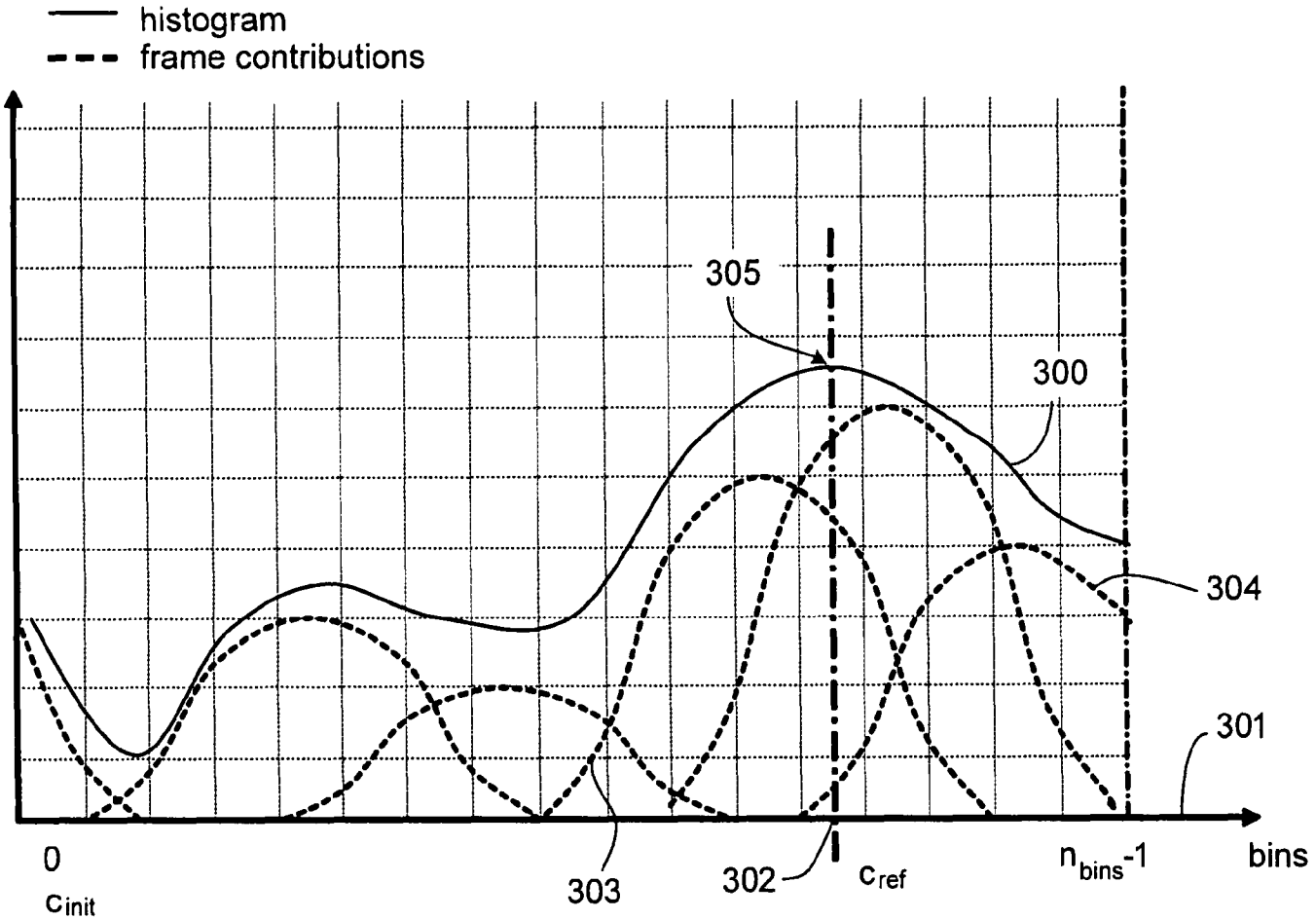
FIG. 3 is a histogram.

Therefore, $c_{init}$ refers to the value of $f_{init}$ expressed in cents relative to 440 Hz. FIG. 3 is a diagram of a histogram 300. The histogram 300, as shown in FIG. 3, covers 1 semitone of possible deviation. In addition, the axis 301 is discrete with a certain deviation resolution $c_{res}$ such as 1 cent, although different resolutions may be used as well. The number of histogram bins on the axis 301 is given by the following relationship:

$$n_{bins} = \frac{100}{c_{res}}$$

Referring to the example of an audio recording 105 of a human singing voice, voiced frames are frames having a pitch, or having a pitch greater than minus infinity ($-\infty$), while unvoiced frames are frames not having a pitch, or having pitch equal to $-\infty$. As shown in FIG. 3, the histogram 300 may be generated by the segmentation unit 111 by adding a number to the bin (bin "0" to bin $n_{bins}-1$") corresponding to the deviation from the frequency of reference, $c_{init}$, of each voiced frame, with unvoiced frames not considered in the histogram 300. This number added to the histogram 300 may be a constant but also may be a weight representing the relevance of that frame. For example, one possible technique is to give more weight to frames where the included pitch or fundamental frequency is stable by assigning higher weights to frames where the values of the pitch function derivative are low.

Other techniques may be used as well. The bin b corresponding to a certain fundamental frequency c is found by the following relationships:

$$y = c - \left\lfloor \frac{c}{100} \right\rfloor \cdot 100$$

$$z = \left\lfloor \frac{y}{c_{res}} + .5 \right\rfloor$$

$$b = \begin{cases} z & \text{if } z < n_{bins} \\ 0 & \text{if } z = n_{bins} \end{cases}$$

As shown in FIG. 3, in order to smooth the resulting histogram 300 and improve its robustness to noisy fundamental frequency estimations, the segmentation unit 111, instead of adding a number to a single bin, may use a bell-shaped window, see, e.g., window 303 on FIG. 3, that spans over several bins when adding to the histogram 300 the contribution of each voiced frame. Since the histogram axis 301 may be wrapped to 1 semitone deviation, adding a window 304 around a boundary value of the histogram would contribute also to other boundaries in the histogram. For example, if a bell-shaped window 304 spanning over 7 bins was to be added at bin number "$n_{bins}-2$", it would contribute to the bins from number "$n_{bins}-5$" to "$n_{bins}-1$" and to bins 0 and 1. This is because the bell-shaped window 304 contribution goes beyond the boundary bin "$n_{bins}-1$" and the contribution that is added to bins beyond bin "$n_{bins}-1$" falls in a different semitone, and thus, because of the wrapping of the histogram 300, the contribution is added to bins closer to the other boundary, in this case bins number 0 and 1. The maximum 305_of this continuous histogram 300 determines the tuning frequency $c_{ref}$ in cents from the initial frequency $c_{init}$.

2. Note Segmentation (202)

Referring again to FIG. 2, the segmentation unit 111 may segment the audio recording 105 (made up of frames) into notes by using a dynamic programming algorithm (202). The algorithm may include four parameters that may be used by the segmentation unit 111 to determine the note duration and note pitch limits, respectively $d_{min}$, $d_{max}$, $c_{min}$ and $c_{max}$ for the note segmentation. Example values for note duration for an audio recording 105 of a human voice singing would be between 0.04 seconds ($d_{min}$) and 0.45 seconds ($d_{max}$), and for note pitch between −3700 cents ($c_{min}$) and 1500 cents ($c_{max}$). Regarding the note duration, in an implementation, the maximum duration $d_{max}$ may be long enough as to cover several periods of a vibrato with a low modulation frequency, e.g. 2.5 Hz, but short enough as to have a good temporal resolution, for example, a resolution that avoids skipping notes with a very short duration. Vibrato is a musical effect that may be produced in singing and on musical instruments by a regular pulsating change of pitch, and may be used to add expression to a singing or vocal-like qualities to instrumental music. Regarding the fundamental frequency limits $c_{min}$ and $c_{max}$, in an implementation, the range of note pitches may be selected to cover a tessitura of a singer, i.e., the range of pitches that a singer may be capable of singing.

Figure 4:
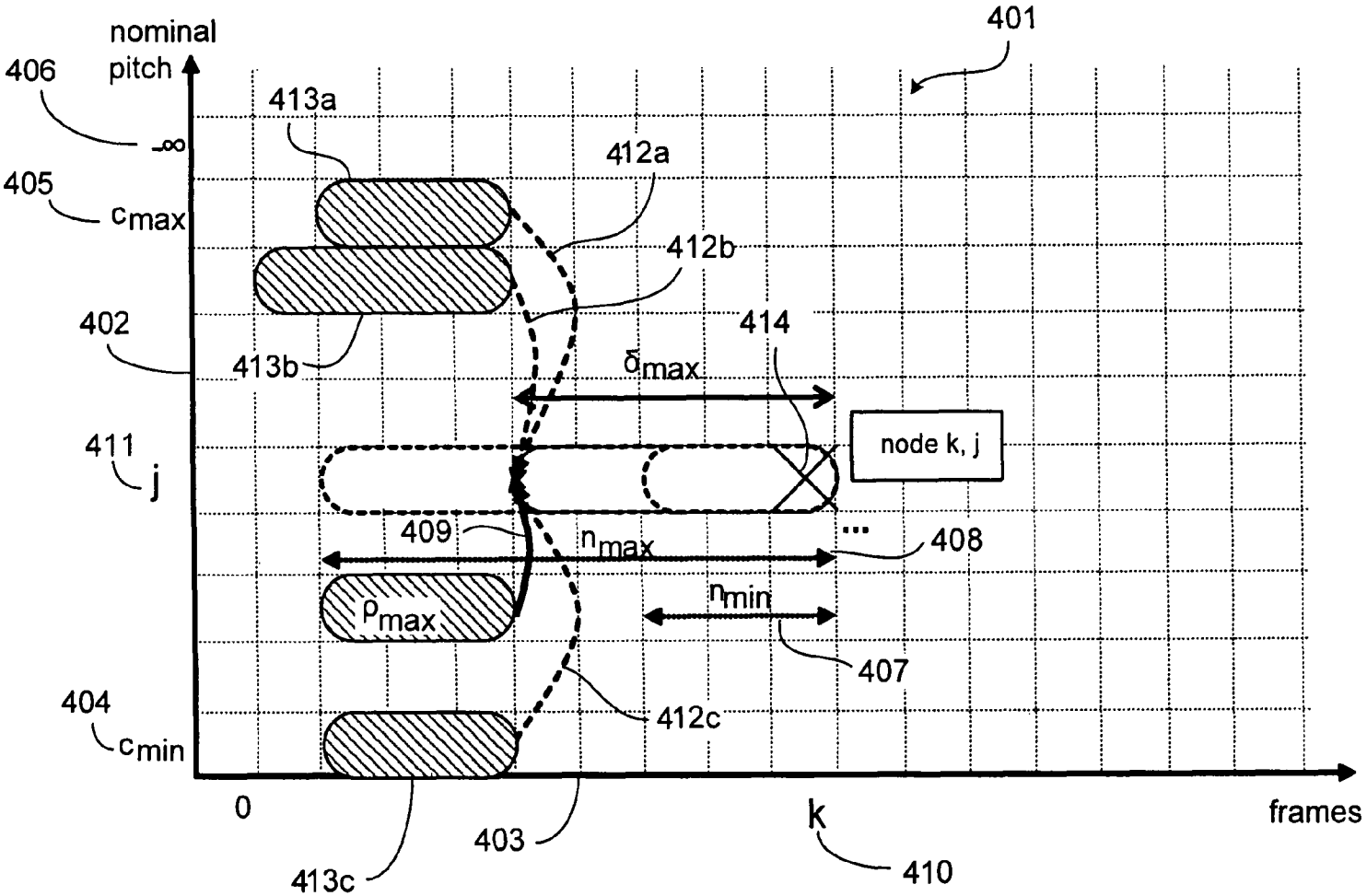
FIGS. 4 and 5 are matrix diagrams showing nominal pitch versus frames.

FIG. 4 is a diagram showing a matrix M 401. In an implementation, the dynamic programming technique of the segmentation unit 111 may search for a preferred (e.g., most optimal) path of all possible paths along the matrix M 401. The matrix 401 has possible note pitches or fundamental frequencies as rows 402 and audio frames as columns 403, in the order that the frames occur in the audio recording 105. The possible fundamental frequencies C include all the semitones between $c_{min}$ 404 and $c_{max}$ 405, plus minus infinity 406 (−∞) (referring to an unvoiced segment of frames): $C=\{-\infty, c_{min}, \ldots, c_{max}\}$. Any nominal pitch value $c_i$ between $c_{min}$ 404 and $c_{max}$ 405 has a deviation from the previously estimated tuning reference frequency $c_{ref}$ that is a multiple of 100 cents. A note N, may have any duration between $d_{min}$ and $d_{max}$ seconds. However, since the input low-level features 106 received by the segmentation unit 111 may have been determined at a certain rate, the duration $d_i$ of the note $N_i$ may be quantized to an integer number of frames, with $n_i$ being the duration in frames. Therefore, if the time interval between two consecutive analysis frames is given by $d_{frame}$ seconds, the duration limits $n_{min}$ 407 and $n_{max}$ 408 in frames will be:

$$n_{min} = \left\lceil \frac{d_{min}}{d_{frame}} \right\rceil$$

$$n_{max} = \left\lfloor \frac{d_{max}}{d_{frame}} \right\rfloor$$

In an implementation, possible paths for the dynamic programming algorithm may always start from the first frame selected from the audio recording 105, may always end at the last audio frame of the audio recording 105, and may always advance in time so that, when notes are segmented from the frames, the notes may not overlap. A path P may be defined by a sequence of m notes $P=\{N_0, N_1, \ldots, N_{m-1}\}$, where each note $N_i$ begins at a certain frame $k_i$, has a pitch deviation of $c_i$ in cents relative to the tuning reference $c_{ref}$, and a duration of $n_i$ frames or $d_i$ seconds.

In an implementation, the most optimal path may be defined as the path with maximum likelihood among all possible paths. The likelihood $L_P$ of a certain path P may be determined by the segmentation unit 111 as the multiplication of likelihoods of each note $L_{N_i}$ by the likelihood of each jump, e.g., jump 409 in FIG. 4, between two consecutive notes $L_{N_{i-1},N_i}$, that is $$L_P = L_{N_0} \cdot \prod_{i=1}^{m-1} L_{N_i} \cdot L_{N_{i-1},N_i}$$

In an implementation, the segmentation unit 111 may determine an approximate most optimal path with approximately the maximum likelihood by advancing the matrix columns from left to right, and for each $k^{th}$ column (frames) 410 decide at each $j^{th}$ row (nominal pitch) 411 (see node (k,j) 414 in FIG. 4), an optimal note duration and jump by maximizing the note likelihood times the jump likelihood times the previous note accumulated likelihood among all combinations of possible note durations, possible jumps 412*a*, 412*b*, 412*c*, and possible previous notes 413*a*, 413*b*, 413*c*. This maximized likelihood is then stored as the accumulated likelihood for that node of the matrix (denoted as $\hat{L}_{k,j}$), and the corresponding note duration and jump are stored as well in that node 414. Therefore, $$\begin{aligned} \hat{L}_{k,j} &= L_{N_{k,i}}(\delta_{max}) \cdot L_{N_{k-\delta_{max},\rho_{max}},N_{k,i}} \cdot \hat{L}_{k-\delta_{max},\rho_{max}} \\ &= \max\left(L_{N_{k,i}}(\delta) \cdot L_{N_{k-\delta,\rho},N_{k,i}} \cdot \hat{L}_{k-\delta,\rho}\right), \end{aligned}$$

$$\forall\, \delta \in [n_{min}, n_{max}],\ \forall\, \rho \in [0, C_n - 1]$$

where δ is the note duration in frames, and ρ the row index of the previous note using zero-based indexing. For the first column, the accumulated likelihood is 1 for all rows ($\hat{L}_{0,j}=1$, ∀j [0, $C_n-1$]). The most optimal path of the matrix $P_{max}$ may be obtained by first finding the node of the last column with a maximum accumulated likelihood, and then by following its corresponding jump and note sequence.

a. Jump Likelihood

The likelihood of a note connection (i.e., a jump 412*a*, 412*b*, 412*c in* the matrix 401 between notes) may depend on the type of musical motives or styles that the audio recording 105 or recordings might be expected to feature. If no particular characteristic is assumed a priori for the sung melody, then all possible note jumps would have the same likelihood, $L_{N_{i-1},N_i}$, as shown by the following relationship:

$$L_{N_{i-1},N_i}=1, \forall i \in [1, C_n-1]$$

Otherwise, statistical analysis of melody lines in the expected styles may generally result into different jump likelihoods depending on the local melodic context, and the particular characteristic(s) assumed for the audio recording 105.

b. Note Likelihood

The likelihood $L_{N_i}$ of a note $N_i$, such as notes 413*a*, 413*b*, 413*c* of FIG. 4, may be determined as the product of several likelihood functions based on the following criteria: duration ($L_{dur}$), fundamental frequency ($L_{pitch}$), existence of voiced and unvoiced frames ($L_{voicing}$), and other low-level features 106 related to stability ($L_{stability}$). Other criteria may be used. The product of the likelihood functions is shown in the following equation for the note likelihood $L_{N_i}$:

$$L_{n_i}=L_{dur}\cdot L_{pitch}\cdot L_{voicing}\cdot L_{stability}$$

The segmentation unit 111 may determine each of these likelihood functions as follows:

Duration likelihood

The duration likelihood $L_{dur}$ of a note $N_i$ may be determined so that the likelihood is small, i.e., low, for short and long durations. $L_{dur}$ may be determined using the following relationships, although other techniques may be used:

$$L_{dur}(N_i)=\begin{cases} e^{-\frac{(d_i-h)^2}{\sigma_{dl}^2}} & \text{if } d_i < h \\ e^{-\frac{(d_i-h)^2}{\sigma_{dr}^2}} & \text{if } d_i >= h \end{cases}$$

where h is the duration with maximum likelihood (i.e., 1), $\sigma_{dl}$ the variance for shorter durations, and $\sigma_{dr}$ the variance for longer durations. Example values would be h=0.11 seconds, $\sigma_{dl}$=0.03 and $\sigma_{dl}$=0.7, which may be given by experimentation, for example with the system 100, although these values may be parameters of the system 100 and may be tuned to the characteristics of the audio recording 105.

Pitch likelihood

The pitch likelihood $L_{pitch}$ of a note $N_i$ may be determined so that the pitch likelihood is higher the closer that the estimated pitch contour values is to the note nominal pitch $c_i$, and so that the pitch likelihood is lower the farther the estimated pitch contour values is from the note nominal pitch $c_i$. With $\hat{c}'_k$ being the estimated pitch contour for the $k^{th}$ frame, the following equations may be used:

$$E_{pitch}=\frac{\sum_{k=k_i}^{k_i+n_i-1} w_k|c_i-\hat{c}_k|}{\sum_{k=k_i}^{k_i+n_i-1} w_k}$$

$$L_{pitch}(N_i)=e^{-\frac{E_{pitch}^2}{2\sigma_{pitch}^2}}$$

where $E_{pitch}$ is the pitch error for a particular note $N_i$ having a duration of $n_i$ frames or $d_i$ seconds, $\sigma_{pitch}$ is a parameter given by experimentation with the system 100 and $w_k$ is a weight that may be determined out of the low-level descriptors 106. Different strategies may be used for weighting frames, i.e., for determining $w_k$ , such as giving more weight to frames with stable pitch, such as frames where the first derivative of the estimated pitch contour $\hat{c}'_k$ is near 0.

Voicing likelihood

The voicing likelihood $L_{voicing}$ of a note $N_i$ may be determined as a likelihood of whether the note is voiced (i.e., has a pitch) or unvoiced (i.e., has a pitch of negative infinity). The determination may be based on the fact that a note with a high percentage of unvoiced frames of the $n_i$ frames is unlikely to be a voiced note, while a note with a high percentage of voiced frames of the $n_i$ frames is unlikely to be an unvoiced note. The segmentation unit 111 may determine the voicing likelihood according to the following relationships, although other techniques may be used:

$$L_{voicing}(N_i)=\begin{cases} e^{-\frac{\left(\frac{n_{unvoiced}}{n_i}\right)^2}{2\sigma_v^2}} & \text{if voiced note (i.e. } c_i > -\infty) \\ e^{-\frac{\left(\frac{n_i-n_{unvoiced}}{n_i}\right)^2}{2\sigma_u^2}} & \text{if unvoiced note (i.e. } c_i = -\infty) \end{cases}$$

where $\sigma_v$, and $\sigma_u$ are parameters of the algorithm which may be given by experimentation, for example with the system 100, although these values may be parameters of the system 100 and may be tuned to the characteristics of the audio recording 105, $n_{unvoiced}$ is the number of unvoiced frames in the note $N_i$, and $n_i$ the number of frames in the note.

Stability likelihood

The stability likelihood $L_{stability}$ of a note $N_i$ may be determined based on a consideration that a significant timbre or energy changes in the middle of a voiced note may be unlikely to happen, while significant timbre or energy changes may occur in unvoiced notes. This is because in traditional singing, notes are often considered to have a stable timbre, such as a single vowel. Furthermore, if a significant change in energy occurs in the middle of a note, this may generally be considered as two different notes.

$$a_{max}(N_i)=\max_k(w_k\cdot a_k),\ \forall k \in [k_i, k_i+n_i-1]$$

$$s_{max}(N_i)=\max_k(w_k\cdot s_k),\ \forall k \in [k_i, k_i+n_i-1]$$

$$L_1(N_i)=\begin{cases} e^{-\frac{(a_{max}-a_{threshold})^2}{2\sigma_a^2}} & \text{if } a_{max} > a_{threshold} \\ 1 & \text{if } a_{max} \le a_{threshold} \end{cases}$$

-continued $$L_2(N_i) = \begin{cases} e^{-\frac{(s_{max}-s_{threshold})^2}{2\sigma_s^2}} & \text{if } s_{max} > s_{threshold} \\ 1 & \text{if } s_{max} \le s_{threshold} \end{cases}$$

$$L_{stability}(N_i) = \begin{cases} L_1(N_i)\cdot L_2(N_i) & \text{if voiced note (i.e. } c_i > -\infty) \\ 1 & \text{if unvoiced note (i.e. } c_i = -\infty) \end{cases}$$

where $\alpha_k$ is one of the low-level descriptors 106 that may be determined by the low-level features extraction unit 110 and measures the energy variation in decibels (with $\alpha_k$ having higher values when energy increases), $s_k$ is one of the low-level descriptors 106 and measures the timbre variation (with higher values of $s_k$ indicating more changes in the timbre), and $w_k$ is a weighting function with low values at boundaries of the note $N_i$ and being approximately flat in the center, for instance having a trapezoidal shape. Also, $L_1(N_i)$ is a Gaussian function with a value of 1 if the energy variation $\alpha_k$ is lower than a certain threshold, and gradually decreases when $\alpha_k$ is above this threshold. The same applies for $L_2(N_i)$ with respect to the timbre variation $s_k$.

3. Iterative note consolidation and tuning refining

Referring again to FIG. 2, as described above, the segmentation unit 111 may use an iterative process (203, 204, 205, 206) that may include three operations that may be repeated until the process converges to define a preferred path of notes, so that there may be no more changes in the note segmentation. The segmentation unit 111 may perform note consolidation (203), with short notes from the note segmentation (202) being consolidated into longer notes (203). The segmentation unit 111 may refine the tuning reference frequency (204). The segmentation unit 111 may then redetermine the nominal fundamental frequency (205). The segmentation unit 111 may decide (206) whether the note segmentation (202) used for note consolidation (203) has changed, as e.g., a result of the iterative process. If the note segmentation has changed (at 206), that may mean that the current note segmentation has not converged yet and therefore may be improved or optimized, so the segmentation unit 111 may repeat the iterative process (203, 204, 205, 206). The note segmentation 202 may be included as part of the iterative process of the note segmentation unit 111.

Note Consolidation (203):

Segmented notes that may be determined in the note segmentation (202) have a duration between $d_{min}$ and $d_{max}$ but longer notes may have been, e.g, sung or played in the audio recording 105. Therefore, it is logical for the segmentation unit 111 to consolidate consecutive voiced notes into longer notes if they have the same pitch. On the other hand, significant energy or timbre changes in the note connection boundary are indicative of phonetic changes unlikely to happen within a note, and thus may be indicative of consecutive notes being different notes. Therefore, in an implementation, the segmentation unit 111 may consolidate notes if the notes have the same pitch and the stability measure $\bar{L}_{stability}(N_{i-1},N_i)$ of the connection between the notes is below a certain threshold $\bar{L}_{threshold}$. One possible way of determining such a stability measure is shown in the following equations:

$$\bar{a}_{max}(N_i) = \max_k(w_k \cdot a_k),\ \forall\, k \in [k_i - \bar{\delta}, k_i + \bar{\delta}]$$

$$\bar{s}_{max}(N_i) = \max_k(w_k \cdot s_k),\ \forall\, k \in [k_i - \bar{\delta}, k_i + \bar{\delta}]$$

-continued $$\bar{L}_1(N_i) = \begin{cases} e^{-\frac{(\bar{a}_{max}-\bar{a}_{threshold})^2}{2\sigma_{\bar{a}}^2}} & \text{if } \bar{a}_{max} < \bar{a}_{threshold} \\ 1 & \text{if } \bar{a}_{max} \ge \bar{a}_{threshold} \end{cases}$$

$$\bar{L}_2(N_i) = \begin{cases} e^{-\frac{(\bar{s}_{max}-\bar{s}_{threshold})^2}{2\sigma_{\bar{s}}^2}} & \text{if } \bar{s}_{max} < \bar{s}_{threshold} \\ 1 & \text{if } \bar{s}_{max} \ge \bar{s}_{threshold} \end{cases}$$

$$\bar{L}_{stability}(N_{i-1}, N_i) = \begin{cases} \bar{L}_1(N_i)\cdot \bar{L}_2(N_i) & \text{if voiced note (i.e. } c_i > -\infty) \\ 1 & \text{if unvoiced note (i.e. } c_i = -\infty) \end{cases}$$

where $\alpha_k$ is one of the low-level descriptors 106 that may be determined by the low-level features extraction unit 110 and measures the energy variation in decibels (with $\alpha_k$ having higher values when energy increases), $s_k$ is one of the low-level descriptors 106 and measures the timbre variation (with higher values of $s_k$ indicating more changes in the timbre), and $w_k$ is a weighting function with low values at $k_i-\bar{\delta}$ and $k_i+\bar{\delta}$ and being maximal at $k_i$, for instance having a trapezoid or a triangle shape centered at $k_i$. In addition, $\bar{\delta}$ is a parameter that may be used to control the wideness of the weighting function, with a few tenths of milliseconds being a practical value for $\bar{\delta}$. Therefore, the segmentation unit 111 may consolidate consecutive notes $N_{i-1}$ and $N_i$ into a single note when the following criteria are met: $c_{i-1}=c_i$ and $\bar{L}_{stability}(N_{i-1}, N_i) < \bar{L}_{threshold}$. These criteria may be one measure that the note segmentation unit 111 may use to determine whether consecutive notes are equivalent (or substantially equivalent) to one another and thus may be consolidated. Other techniques may be used.

Tuning Frequency Reestimation or Refinement (204):

As described above, the note segmentation unit 111 may initially estimate the tuning frequency $c_{ref}$ (201) using the fundamental frequency contour. Once note segmentation (202) has occurred however, it may be advantageous to use the note segmentation to refine the tuning frequency estimation. In order to do so, the segmentation unit 111 may determine a pitch deviation measure for each voiced note, and may then obtain the new tuning frequency from a histogram of weighted note pitch deviations similar to that described above and as shown in FIG. 3, with one difference being that a value may be added for each voiced note instead of for each voiced frame. The weight may be determined as a measure of the salience of each note, for instance by giving more weight to longer and louder notes.

The note pitch deviation $N_{dev,i}$ of the $i^{th}$ note is a value measuring the detuning of each note (i.e., the note pitch deviation from the note nominal pitch $c_i$), which may be determined by comparing the pitch contour values and the note nominal pitch $c_i$. Among other approaches, a similar equation as the one used for the pitch error $E_{pitch}$ in the pitch likelihood $L_{pitch}$ determination for a note $N_i$ above may be employed as shown in the following equation:

$$N_{dev,i} = \frac{\sum_{k=k_i}^{k_i+n_i-1} w_k \cdot (c_i - \hat{c}_k)}{\sum_{k=k_i}^{k_i+n_i-1} w_k}$$

where $n_i$ is the number of frames of the note, $c_i$ is the nominal pitch of the note, $\hat{c}_k$ is the estimated pitch value for the $k^{th}$ frame, and $w_k$ is a weight that may be determined from out of the low-level descriptors 106. Different strategies may be used for weighting frames, such as giving more weight to frames with stable pitch, for example. The resulting pitch deviation values may be expressed in semitone cents in the range [−50,50). Therefore, the value $N_{dev}$ may be wrapped into that interval if necessary by adding an integer number of semitones $$N_{dev,i}^{wraped} = N_{dev,i} - \left\lfloor \frac{N_{dev,i}}{100} + 0.5 \right\rfloor \cdot 100$$

As previously noted, the segmentation unit 111 may determine a pitch deviation measure for each voiced note, and may then obtain the new tuning frequency from a histogram of weighted note pitch deviations similar to that described above and as shown in FIG. 3, with one difference being that a value may be added for each voiced note instead of for each voiced frame. The histogram may be generated by adding a number to the bin corresponding to the deviation of each voiced note, with unvoiced notes not considered. This number added to the histogram may be a constant but may also be a weight representing the salience of each note obtained, for example, by giving more weight to longer and louder notes. The bin b corresponding to a certain wrapped note pitch deviation $N_{dev}^{wrapped}$ is given by $$z = \left\lfloor \frac{N_{dev}^{wrapped}}{H_{res}} + 0.5 \right\rfloor$$

$$b = \begin{cases} z & \text{if } z < \frac{n_{bins}}{2} \\ -\frac{n_{bins}}{2} & \text{if } z = \frac{n_{bins}}{2} \end{cases}$$

where $H_{res}$ is the histogram resolution in cents, and $n_{bins}=100/H_{res}$. Note that bins are in the range $$\left[-\frac{n_{bins}}{2}, \frac{n_{bins}}{2} - 1\right]$$

(compare with FIG. 3, which has bins along the histogram axis in the range $[0, n_{bins}-1]$). A practical value is to set $H_{res}=1$ cent, so that the bin values from −50 to +49 cents. The bin of the maximum of the histogram (noted as $b_{max}$) determines the deviation from the new tuning frequency reference relative to the current tuning frequency reference. Thus, the refined tuning frequency at the $u^{th}$ iteration may be determined from the previous iteration tuning frequency by the following relationship:

$$c_{ref}^{u}=c_{ref}^{u-1}+b_{max}^{u}$$

where $c_{ref}^{0}=c_{ref}$, and u=1 for the first iteration.

Note nominal fundamental frequency reestimation (205):

If the tuning reference has been refined, then the note segmentation unit 111 may also need to correspondingly update the nominal note pitch (i.e., the nominal note fundamental frequency) by adding the same amount of variation, so that the nominal note pitch at the $u^{th}$ iteration may be determined from the previous iteration nominal note pitch by the following relationship:

$$c_i^{u}=c_i^{u-1}b_{max}^{u}, \forall i \in [0,m-1]$$

Conversely, the segmentation unit 111 may also need to correspondingly modify the note pitch deviation value by adding the inverse variation, as shown in the following relationship:

$$N_{dev,i}^{u}=N_{dev,i}^{u-1}-b_{max}^{u}, \forall i \in [0m-1]$$

In the event that the updated note pitch deviation leaves the [−50,50) range of bin values, i.e., the updated note pitch is closer to a different note one or more semitones above or below, the note nominal pitch may need to be adjusted by one or more semitones so that the pitch deviation falls within the [−50,50) target range of bin values. This may be achieved by adding or subtracting one or more semitones to the note nominal pitch, while subtracting or adding respectively the same amount from the note pitch deviation. According to one example, if the note pitch deviation is +65 cents and the nominal pitch −800, the pitch value including both nominal and deviation values would be −800+65=−735 cents. Then 100 should be added to the note nominal pitch and 100 subtracted from the pitch deviation. This would result into a pitch deviation of −35 cents and a nominal pitch of −700 cents, resulting into the same absolute pitch value, i.e., −700+(−35)=−735 cents.

Figure 5:
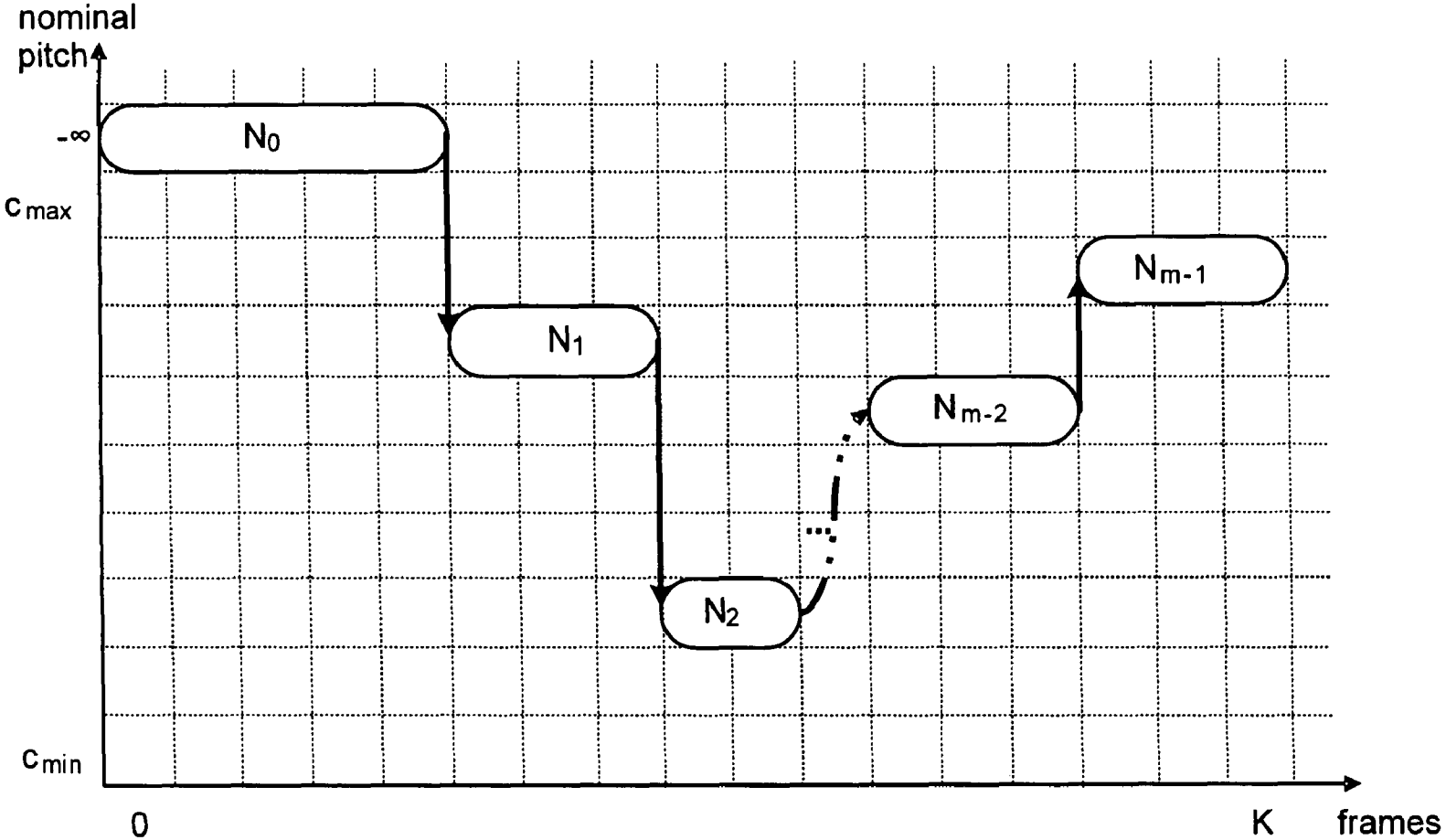

FIG. 5 shows a final segmentation that may be provided by segmentation unit 111, which includes the sequence of m notes $P=\{N_0,N_1,\ldots,N_{m-1}\}$ with their duration (in number of frames) and the jumps between notes.

4. Note Description (207)

From the note segmentation unit 111, a sequence of notes 108 may be obtained (see FIG. 1 and also FIG. 5). For each note in the sequence, three values 610 may be provided by the segmentation unit 111: nominal pitch $c_i$, beginning time, and end time.

Figure 6:
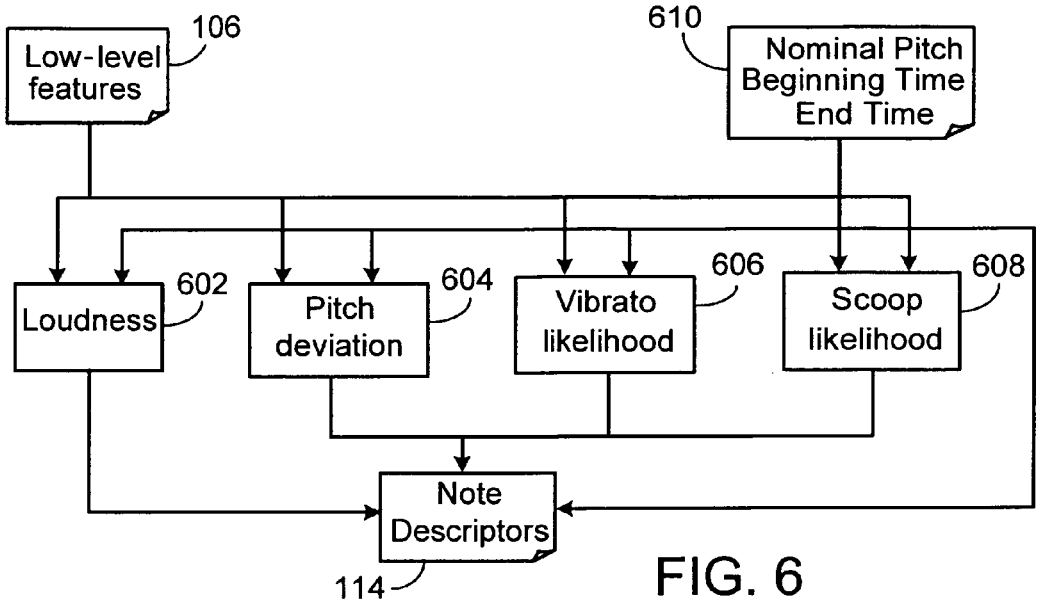
FIGS. 6 and 7 are functional block diagrams.

The input to the notes descriptor unit 112 may also include the low-level features 106 determined by the low-level features extraction unit 110, as shown in FIG. 2 and FIG. 6. In particular, low-level features 106, such as amplitude contour, the first derivative of the amplitude contour, fundamental frequency contour, and the MFCC, may be used in the notes descriptor unit 112.

As shown in FIG. 6, the note description unit 112 may add four additional values to the note descriptors 114 for each note in the sequence: loudness 602 pitch deviation 604, vibrato likelihood 606 and scoop likelihood 608. Other values may used.

The descriptors may be determined as follows:

Loudness: A loudness value 602 for each note may be determined as the mean of the amplitude contour values across all the frames contained in a single note. The loudness 602 may be converted to a logarithmic scale and multiplied by a scaling factor k so that the value 602 is in a range [0 . . 1].

Pitch deviation: A pitch deviation value 604 may be determined and the value 604 may be the pitch deviation $N_{dev,i}$ as determined for each note in the Tuning Frequency Reestimation (204).

Vibrato Likelihood: Vibrato is a musical effect that may be produced in singing and on musical instruments by a regular pulsating change of pitch, and may be used to add expression to a singing or vocal-like qualities to instrumental music. One or more techniques may be employed to detect the presence of vibrato from a monophonic audio recording, extracting a measure for vibrato rate and vibrato depth. Techniques that may be used include monitoring the pitch contour modulations, including detecting local minimums and local maxima of the pitch contour. For each note, the vibrato likelihood is a measure in a range [0 . . 1 ] determined from values of vibrato rate and vibrato depth. A value of 1 may indicate that the note contains a high quality vibrato. The value of vibrato likelihood $L_{vibrato}$ for a note i is determined by multiplying three partial likelihoods, $L_{vibrato}=L_1 \cdot L_2 \cdot L_3$ using the following general function $L_i$ (x).

$$L_i(x) = \begin{cases} e^{\frac{(x-\mu_i)^2}{2\sigma_i^2}} & \text{if } x > \mu_i \\ 1 & \text{if } x \le \mu_i \end{cases}$$

where σi and $\mu_i$ be found experimentally, $L_1$ penalizes notes with a duration below 300 ms, $L_2$ penalizes if the detected vibrato rate is outside of a typical range [2,5 . . 6,5], and $L_3$ penalizes if the estimated vibrato depth is outside of a typical range [80 . . 400] in semitone cents.

Scoop Likelihood: A scoop is a musical ornament, which may be spontaneously provided by a singer, and may include a short rise or decay of the fundamental frequency contour before a stable note. For example, a "good" singer may link two consecutive notes by introducing a scoop at the beginning of the second note in order to produce a smoother transition. Introducing this scoop may generally result more pleasant and elegant singing as perceived by a listener. The value of scoop likelihood $L_{scoop}$ for a note i may be determined by multiplying three partial likelihoods, $L_{scoop}=L_1 \cdot L_2 \cdot L_3$ using the following general function $L_i$(x) immediately above, where again σi and $\mu_i$ may be determined experimentally. Here, $L_1$ penalizes notes whose duration is longer than the duration of the note i+1; $L_2$ penalizes notes with a duration above 250 ms, and $L_3$ penalizes if the following note connection (between i and i+1) has a stability likelihood $L_{stability}(N_i, N_{i+1})$ (see above) above a threshold that may be given experimentally.

The Rating Component 102

Generally, in rating the audio recording 105, the system 100 need not, and in numerous implementations does not, refer or make comparison to a static reference such as a previously known musical composition, score, song, or melody.

The rating component 102 may receive the note descriptor values 114 output from the note descriptor unit 112 of the note segmentation and description component 101 as inputs and may pass them to the tuning rating unit 120, the expression rating unit 121, and the rating validity unit 123. Each note in the sequence of notes 108 identified and described by the note segmentation and description component 101 and output by the segmentation unit 111 may generally have a corresponding set of note descriptor values 114.

The tuning rating unit 120 may receive as inputs note descriptor values 114 corresponding to each note, such as the fundamental frequency deviation of the note and the duration of the note. The tuning rating unit 120 may determine a tuning error function across all of the notes of the audio recording 105. The tuning error function may be based on the note pitch deviation value as determined by the note descriptor unit 112, since the deviation of the fundamental frequency contour values for each note represents a measure of the deviation of the actual fundamental frequency contour with respect to the nominal fundamental frequency of the note. The tuning error function may be a weighted sum, where for each note the pitch deviation value for the note is weighted according to the duration of the note, as shown in the following equation:

$$err_{tuning} = \frac{\sum_{i=0}^{m-1} w_i \cdot N_{dev,i}}{\sum_{i=0}^{m-1} w_i}$$

where m is the number of notes, $w_i$ may be the square of the duration of the note $d_i$ corresponding to each note and $N_{dev,i}$ represents, for each identified note in the segmentation unit 111, the deviation of the fundamental frequency contour values for each note.

The tuning rating $rating_{tuning}$ may be determined as the complement of the tuning error, as shown in the following equation:

$rating_{tuning}=1-err_{tuning}$.

The tuning rating unit 120 may be used to evaluate the consistency of the singing or playing in the audio recording 105. Consistency here is intended to refer not to, e.g., a previously known musical score or previous performance, but rather to consistency within the same audio recording 105. Consistency may include the degree to which notes being sung (or played) belong to an equal-tempered scale, i.e., a scale wherein the scale notes are separated by equally tempered tones or semi-tones. As previously noted, generally, in rating the audio recording 105, the system 100 need not, and in numerous implementations does not, refer or make comparison to a static reference such as a previously known musical composition, score, song, or melody.

Figure 7:
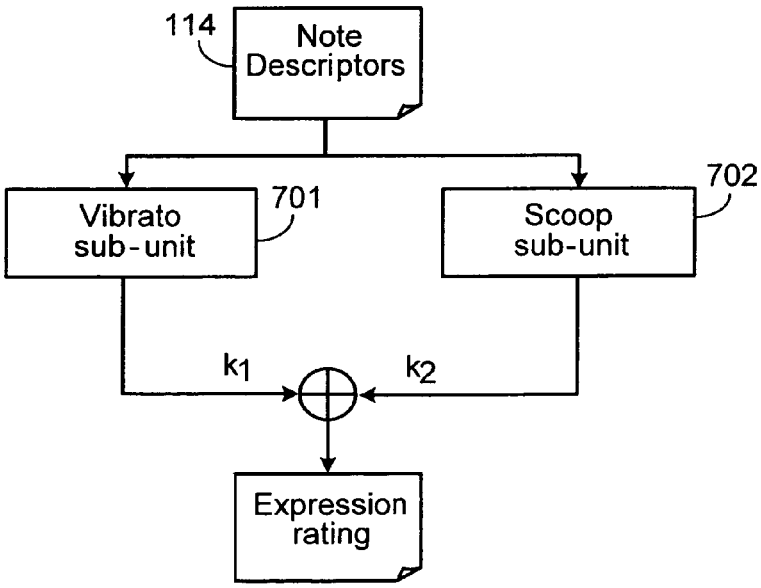

The expression rating unit 121 may receive as inputs from the note segmentation and description component 101 note descriptor values 114 corresponding to each note, such as the nominal fundamental frequency of the note, the loudness of the note, the vibrato likelihood $L_{vibrato}$ of the note, and the scoop likelihood $L_{scoop}$ of the note. As shown in FIG. 7, the expression rating unit 121 of FIG. 1 may include a vibrato sub-unit 701, and a scoop sub-unit 702. The expression rating unit 121 may determine the expression rating across all of the notes of the audio recording 105. The expression rating unit 121 may use any of a variety of criteria to determine the expression rating for the audio recording 105. In an implementation, the criteria may include the presence of vibratos in the recording 105, and the presence of scoops in the recording 105. Professional singers often add such musical ornaments as vibrato and scoop to improve the quality of their singing. These improvised ornaments allow the singer to render more personalized the interpretation of the piece sung, while also making the rendition of the piece more pleasant.

The vibrato sub-unit 201 may be used to evaluate the presence of vibratos in the audio recording 105. The vibrato likelihood descriptor $L_{vibrato}$ may be determined in the notes descriptors unit 112 and may represent a measure of both the presence and the regularity of a vibrato. From the vibrato likelihood descriptor $L_{vibrato}$ that may be determined by the note descriptors unit 112, the vibrato sub-unit 201 may determine the mean of the vibrato likelihood of all the notes having a vibrato likelihood higher than a threshold $T_1$. The vibrato sub-unit 201 may determine the number percentage of notes with a long duration D, e.g., more than 1 second in duration, that have a vibrato likelihood higher than a threshold $T_2$. The vibrato likelihood thresholds $T_1$ and $T_2$, and the duration D, may be, for example, predetermined for the system 100 and may be based on experimentation with and usage history of the system 100. A vibrato rating vibrato may be given by the product of the described mean and of the described percentage, as shown in the following equation:

$$\text{vibrato} = \sqrt{\frac{1}{N}\sum_{N} L_{vibrato}} \cdot \sqrt{\frac{durVibr_{LONG}}{dur_{LONG}}}$$

where $L_{vibrato}$ is the vibrato likelihood descriptor for those notes having a vibrato likelihood higher than the threshold $T_1$, N is the number of notes having a vibrato likelihood higher than the threshold $T_1$, $dur_{LONG}$ is the number of notes with a long duration D, and $durVibr_{LONG}$ is the number of notes having a vibrato likelihood higher than the threshold $T_2$. As vibratos are an ornamental effect, a higher number of notes with a vibrato may be interpreted as a sign skilled singing by a singer or playing by a musician. For example, "good" opera singers have a tendency to use vibratos very often in their performances, and this practice is often considered as high quality singing. Moreover, skilled singers will often achieve a very regular vibrato.

The scoop sub-unit 202 may be used to evaluate the presence of scoops in the audio recording 105. From the scoop likelihood descriptor $L_{scoop}$ determined by the note descriptors unit 112, the scoop sub-unit 202 may determine the mean of the scoop likelihood of all the notes having a scoop likelihood higher than a threshold $T_3$. The threshold $T_3$ may be, for example, predetermined for the system 100 and may be based on experimentation with and usage history of the system 100. A scoop rating scoop may be given by the square of the described mean, as shown in the following equation:

$$\text{scoop} = \left(\frac{1}{N}\sum_{N} L_{scoop}\right)^2$$

where $L_{scoop}$ is the scoop likelihood descriptor for those notes having a scoop likelihood higher than the threshold $T_1$, and N is the number of notes having a scoop likelihood higher than the threshold $T_1$. Mastering the techniques of scoop, just as with the vibrato, is also often considered to be a sign of good singing abilities. For example, jazz singers often make use of this ornament.

The expression rating $rating_{expression}$ may be determined as a linear combination of the vibrato rating vibrato and the scoop rating scoop, as shown in the following equation:

$$rating_{expression} = k_1 \cdot \text{vibrato} + k_2 \cdot \text{scoop}$$

The weighting values $k_1$ and $k_2$ may in general sum to 1, as shown in the following equation:

$$k_1 + k_2 = 1$$

The weighting values $k_1$ and $k_2$ may be, for example, predetermined for the system 100 and may be based on experimentation with and usage history of the system 100. Other criteria may be used in determining the expression rating.

The global rating unit 122 of FIG. 1, may determine the global rating 125 for the singing and the recording 105 as a combination of the tuning rating $rating_{tuning}$ produced by the tuning rating unit 120, and the expression rating $rating_{expression}$ produced by the expression rating unit 121. The combination may use a weighting function so that tuning rating or expression rating values that are closer to the bounds, i.e., to 0 or 1, have a higher relative weight, as shown in the following equation:

$$globalscore = Q \cdot (w_1 \cdot rating_{tuning} + w_2 \cdot rating_{expression})$$

$$w_i = 2 - \exp^{\frac{(x-0.5)^2}{2 \cdot 0.5^2}}.$$

where x is the $rating_{tuning}$ in the equation for the weight $w_1$, and $rating_{expression}$ in the equation for the weight $w_2$, respectively. Using a weighting function for the tuning and expression rating may provide a more consistent global rating 125. The weighting function may give more weight to values that are closer to the bounds, so that very high or very low ratings in tuning or expression (i.e., extreme values) may be given a higher weight than just average ratings. In this way, the global rating 125 of the system 100 may become more realistic to human perception. For example, if there was no weighting, for an audio recording 105 having a very poor tuning rating and just an average expression rating, the system 100 might typically rate the performance as below average while a human listener would almost certainly perceive the audio recording as being of very low quality.

The global rating unit 122 may receive a factor Q (shown above in the equation for the global rating 125) from the validity rating unit 123. The factor Q may provide a measure of the validity of the audio recording 105. In an implementation, the factor Q may take into account three criteria: minimum duration in time ($audio_duration_{MIN}$), minimum number of notes ($N_{MIN}$), and a minimum note range ($range_{MIN}$). Other criteria may be used. Taking into consideration the factor Q is a way that the system 100 may avoid inconsistent or unrealistic ratings due to an improper input audio recording 105. For example, if the audio recording 105 lasted only 2 seconds while including only two notes belonging to two consecutive semitones, the system, absent the factor Q or a similar factor, may generally give the audio recording 105 very high rating, even though the performance would be very poor. By taking into account the factor Q, the system may generally give a very poor rating the example audio recording 105.

The validity rating unit 123 may receive the duration audio_duration, the number of notes in the audio N, and the range range of the audio recording 105 from the note segmentation and description component 101, and may compare these values with the minimum thresholds $audio_dur_{MIN}$, $N_{MIN}$, $range_{MIN}$, as shown in the following equation:

$$Q = f(\text{audio_dur}, \text{audio_dur}_{MIN}) \cdot f(N, N_{MIN}) \cdot f(\text{range}, \text{range}_{MIN})$$

The factor Q may thus be determined as the product of three operators $f(x,\mu)$, where $f(x,\mu)$ is 1 for any value of x above a threshold $\mu$, and gradually decreases to 0 when x is below the threshold $\mu$. The function $f(x,\mu)$ may be a Gaussian operator, or any suitable function that decreases from 1 to 0 when the distance between x and the threshold $\mu$, below the threshold $\mu$, increases. The factor Q may therefore range from 0 to 1, inclusive.

Figure 8:
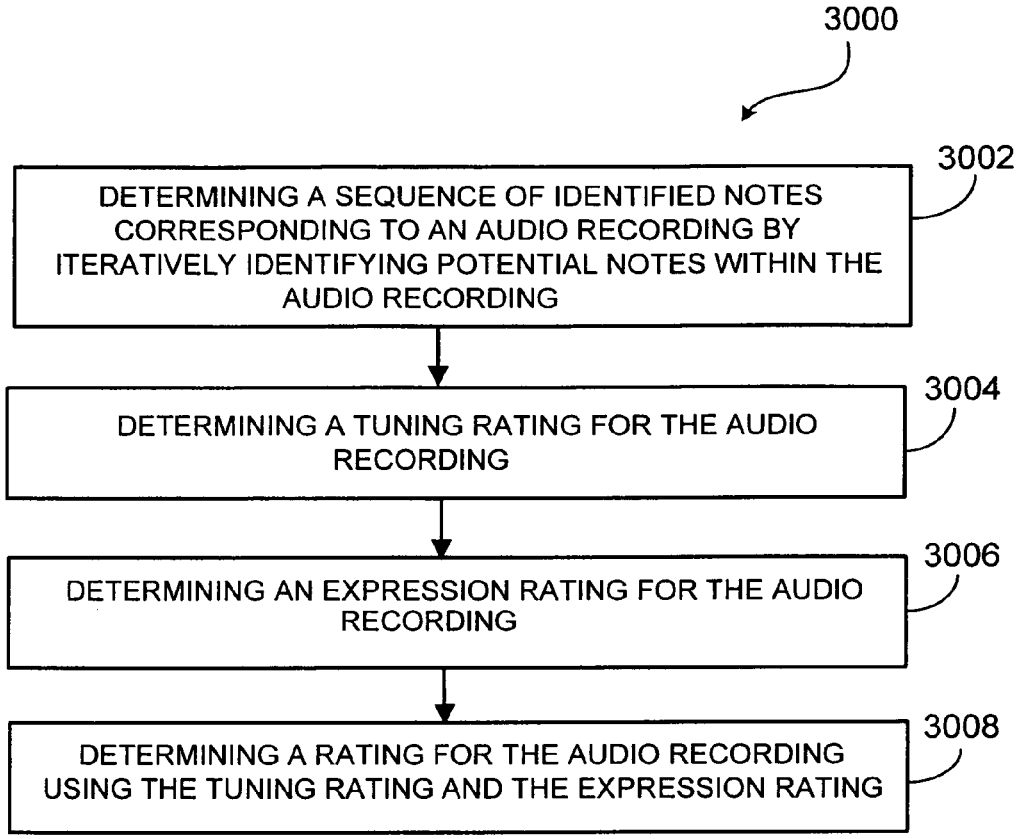
FIG. 8 is a flow chart of an example process.

FIG. 8 is a flow chart of an example process 3000 for use in processing and evaluating an audio recording, such as the audio recording 105. The process 3000 may be implemented by the system 100. A sequence of identified notes corresponding to the audio recording 105 may be determined (by, e.g., the segmentation unit 111 of FIG. 1) by iteratively identifying potential notes within the audio recording (3002). A tuning rating for the audio recording 105 may be determined (3004).

An expression rating for the audio recording 105 may be determined (3006). A rating (e.g., the global rating 125) for the audio recording 105 may be determined (by, e.g., the rating component 102 of FIG. 1) using the tuning rating and expression rating (3008). The audio recording 105 may include a recording of at least a portion of a musical composition. In an implementation, the sequence of identified notes (see, e.g., the sequence of notes 108 in FIG. 2) corresponding to the audio recording 105 may be determined substantially without using any pre-defined standardized version of the musical composition. In an implementation, the rating may be determined substantially without using any pre-defined standardized version of the musical composition. Generally, in analyzing, processing, and evaluating the audio recording 105, the system 100 need not, and in numerous implementations does not, refer or make comparison to a static reference such as a previously known musical composition, score, song, or melody.

The segmentation unit 111 of FIG. 1 may determine the sequence of identified notes (3002) by separating the audio recording 105 into consecutive frames. In an implementation, frames that may correspond to, e.g., unvoiced notes (i.e., having a pitch of negative infinity) may not be considered. The segmentation unit 111 may also select a mapping of notes, such as an path of notes, from one or more mappings (such notes paths) of the potential notes corresponding to the consecutive frames in order to determine the sequence of identified notes. Each note identified by the segmentation unit 111 may have a duration of one or more frames of the consecutive frames.

The segmentation unit 111 may select the mapping of notes by evaluating a likelihood (e.g., the likelihood $L_{N_i}$ of a note $N_i$) of a potential note being an actual note. The likelihood $L_{N_i}$ of a potential note $N_i$ may be evaluated based on several criteria, such as a duration of the potential note, a variance in fundamental frequency of the potential note, or a stability of the potential note, and likelihood functions that may be associated with these criteria, as described above. The segmentation unit 111 may determine one or more likelihood functions, such as, for the one or more mappings of the potential notes, the one or more likelihood functions being based on the evaluated likelihood of potential notes in the one or more mappings of the potential notes. The segmentation unit 111 may select the likelihood function having a highest value, such as a maximum likelihood value.

For example, in an implementation, the most optimal path may be defined as the path with maximum likelihood among all possible paths. For example, the likelihood $L_P$, of a certain path P may be determined by the segmentation unit 111 as the multiplication of likelihoods of each note $L_{N_i}$ by the likelihood of each jump, e.g., jump 409 in FIG. 4, between two consecutive notes as described above.

The segmentation unit 111 may consolidate the selected mapping of notes to group consecutive equivalent notes together within the selected mapping. For example, as described above, the segmentation unit 111 may consolidate consecutive notes $N_{i-1}$ and $N_i$ into a single one when the following criteria are met: $c_{i-1}=c_i$ and $\bar{L}_{stability}(N_{i-1})<\bar{L}_{threshold}$. These criteria may be one measure that the note segmentation unit 111 may use to determine whether consecutive notes are equivalent (or substantially equivalent) to one another and thus may be consolidated. Other techniques may be used. The segmentation unit 111 may determine a reference tuning frequency for the audio recording 105, as described in more detail above.

The tuning rating unit 120 of FIG. 1 may determine a tuning rating for the audio recording 105 (e.g., 3004). The tuning rating unit 120 may receive descriptive values corresponding to identified notes of the audio recording 105, such as the note descriptors 114. The note descriptors 114 for each identified note may include a nominal fundamental frequency value for the identified note and a duration of the identified note. The tuning rating unit 120 may, for each identified note, weight, by a duration of the identified note, a fundamental frequency deviation between fundamental frequency contour values corresponding to the identified note and a nominal fundamental frequency value for the identified note. The tuning rating unit 120 may then sum the weighted fundamental frequency deviations for the identified notes over the identified notes. The tuning error function $err_{tuning}$ may be determined in this manner, as described above.

The expression rating unit 121 of FIG. 1 may determine an expression rating for the audio recording 105 may be determined (e.g., 3006). The expression rating unit 121 may determine a vibrato rating (e.g., vibrato) for the audio recording 105 based on a vibrato probability value such as the vibrato likelihood descriptor $L_{vibrato}$. The vibrato rating may be determined using vibrato probability values for a first set of notes of the identified notes and a proportion of a second set of notes of the identified notes having vibrato probability values above a threshold. Determining the expression rating may also include determining a scoop rating (e.g., scoop) for the audio recording 105 based on a scoop probability value such as the scoop likelihood descriptor $L_{scoop}$. The scoop rating may be determined using the average of scoop probability values for a third set of notes of the identified notes. The expression rating unit 121 may combine the vibrato rating and the scoop rating to determine the expression rating, see, e.g., FIG. 7. The global rating unit 122 of the rating component 102 may determine a global rating 125 for the audio recording 105 using the tuning rating and expression rating (e.g., 3008). The rating validity unit 123 may compare a descriptive value for the audio recording to a threshold and may generate an indication (e.g., the factor Q above) of whether the descriptive value exceeds the threshold. The descriptive value may include at least one of a duration of the audio recording, a number of identified notes of the audio recording; or a range of identified notes of the audio recording, as described above. The global rating unit 122 may multiply a weighted sum of the tuning rating and the expression rating by the indication (e.g., the factor Q above) to determine the global rating 125.

In using the term "may," it is understood to mean "could, but not necessarily must."

In using the "set" as in "a set of elements," it is understood that a set may include one or more elements.

The processes described herein are not limited to use with any particular hardware, software, or programming language; they may find applicability in any computing or processing environment and with any type of machine that is capable of running machine-readable instructions. All or part of the processes can be implemented in digital electronic circuitry, or in computer hardware, firmware, software, or in combinations thereof.

All or part of the processes can be implemented as a computer program product, e.g., a computer program tangibly embodied in one or more information carriers, e.g., in one or more machine-readable storage media or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Actions associated with the processes can be performed by one or more programmable processors executing one or more computer programs to perform the functions of the processes. The actions can also be performed by, and the processes can be implemented as, special purpose logic circuitry, e.g., an FPGA (field programmable gate array) or an ASIC (application-specific integrated circuit). Modules can refer to portions of the computer program and/or the processor/special circuitry that implements that functionality.

Processors suitable for the execution of a computer program include, by way of example, both general and special purpose microprocessors, and any one or more processors of any kind of digital computer. Generally, one or more processors will receive instructions and data from a read-only memory or a random access memory or both. The essential elements of a computer are one or more processors for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

Figure 9:
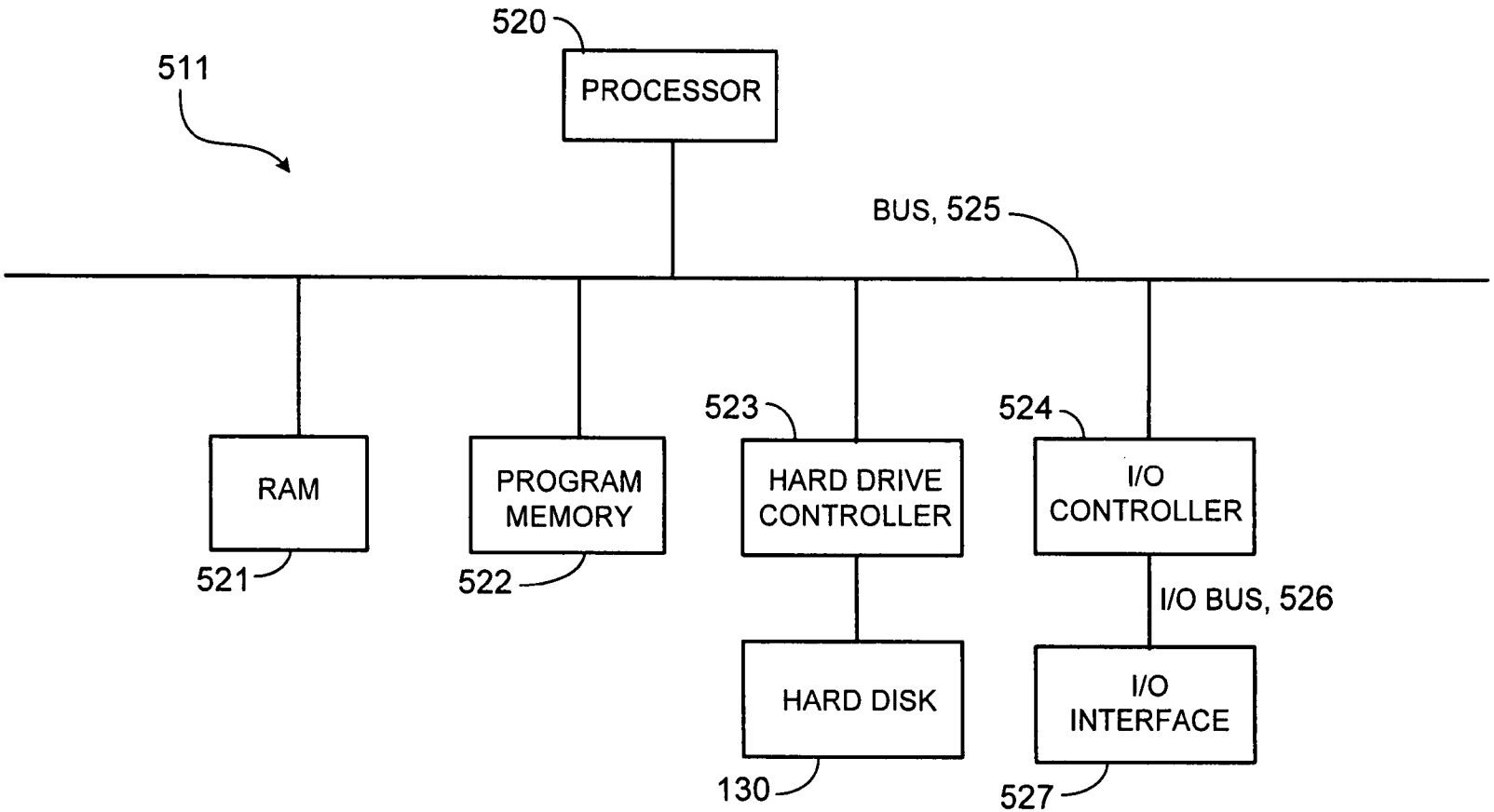
FIG. 9 is a block diagram of a computer system.

An example of one such type of computer is shown in FIG. 9, which shows a block diagram of a programmable processing system (system) 511 suitable for implementing or performing the apparatus or methods described herein. The system 511 includes one or more processors 520, a random access memory (RAM) 521, a program memory 522 (for example, a writeable read-only memory (ROM) such as a flash ROM), a hard drive controller 523, and an input/output (I/O) controller 524 coupled by a processor (CPU) bus 525. The system 511 can be preprogrammed, in ROM, for example, or it can be programmed (and reprogrammed) by loading a program from another source (for example, from a floppy disk, a CD-ROM, or another computer).

The hard drive controller 523 is coupled to a hard disk 130 suitable for storing executable computer programs, including programs embodying the present methods, and data including storage. The I/O controller 524 is coupled by an I/O bus 526 to an I/O interface 527. The I/O interface 527 receives and transmits data in analog or digital form over communication links such as a serial link, local area network, wireless link, and parallel link.

To provide for interaction with a user, the techniques described herein can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer (e.g., interact with a user interface element, for example, by clicking a button on such a pointing device). Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

The techniques described herein can be implemented in a distributed computing system that includes a back-end component, e.g., as a data server, and/or a middleware component, e.g., an application server, and/or a front-end component, e.g., a client computer having a graphical user interface and/or a Web browser through which a user can interact with an implementation of the invention, or any combination of such back-end, middleware, or front-end components. The components of the system can be interconnected by any form or medium of digital data communication, e.g., a communication network. Examples of communication networks include a local area network ("LAN") and a wide area network ("WAN"), e.g., the Internet, and include both wired and wireless networks.

The computing system can include clients and servers. A client and server are generally remote from each other and typically interact over a communication network. The relationship of client and server arises by virtue of computer programs running on the respective computers and having a client-server relationship to each other.

Actions associated with the processes can be rearranged and/or one or more such action can be omitted to achieve the same, or similar, results to those described herein.

Elements of different implementations may be combined to form implementations not specifically described herein.

Numerous uses of and departures from the specific system and processes disclosed herein may be made without departing from the inventive concepts. Consequently, the invention is to be construed as embracing each and every novel feature and novel combination of features disclosed herein and limited only by the spirit and scope of the appended claims.

What is claimed is:

1. A method for use in connection with processing an audio recording, the method comprising the steps of:

providing an input for an audio recording including receiving the audio recording at a note segmentation and description component;

processing the audio recording including extracting a set of low-level features or descriptors from the audio recording; identifying a predetermined sequence of notes; associating each note in the sequence of notes with a set of note descriptors;

determining a rating for tuning of notes playing in the audio recording;

determining an expression rating for the expression of the notes playing in the audio recording;

combining the tuning rating and the expression rating, so as to determine a global rating for the notes playing in the audio recording;

determining a sequence of identified notes corresponding to the audio recording during each successive iterations over at least a portion of the audio recording, identifying potential notes with the portion of the audio recording; and providing an output for the audio recording.

2. A method of processing an audio recording by an audio system comprising at least a note segmentation and description component including at least a low-level features extraction unit, segmentation unit and notes descriptors unit; and a rating component including at least a tuning rating unit, expression rating unit, a validity rating unit and a global rating unit, the method comprising the steps of:

providing an input for determining or processing notes in an audio recording including receiving the audio recording at a note segmentation and description component;

processing the audio recording including extracting a set of low-level features or descriptors from the audio recording in a low-level features extraction unit;

identifying and determining a sequence of notes in the audio recording in a segmentation unit;

associating each note in the sequence of notes with a set of the note descriptors in a note descriptors unit;

determining a rating for tuning of a notes playing in the audio recording in a tuning rating unit;

determining an expression rating for the expression of the notes playing in the audio recording in an expression rating unit;

combining the tuning rating and the expression rating in a global rating unit, so as to determine a global rating for the notes playing in the audio recording;

determining a sequence of the identified notes corresponding to the audio recording during each successive iterations over at least a portion of the audio recording, identifying potential notes with the portion of the audio recording; and providing an output for the audio recording.

3. The method of claim 2, wherein the sequence of identified notes corresponding to the audio recording is determined substantially without using any pre-defined standardized version of the musical composition.

4. The method of claim 2, wherein determining the sequence of identified notes comprises:

separating the audio recording into consecutive frames;

selecting a mapping of notes from one or more mappings of the potential notes corresponding to the consecutive frames, wherein each identified note has a duration of one or more frames of the consecutive frames.

5. The method of claim 4, wherein selecting the mapping of notes comprises:

evaluating a likelihood of a potential note of the potential notes being notes based on at least one of a duration of the potential note, a variance in fundamental frequency of the potential note, or a stability of the potential note.

6. The method of claim 5, wherein selecting the mapping of notes further comprises:

determining one or more likelihood functions for the one or more mappings of the potential notes, the one or more likelihood functions being based on the evaluated likelihood of potential notes in the one or more mappings of the potential notes; and selecting the likelihood function based on the relative values of the likelihood functions.

7. The method of claim 4, further comprising:

consolidating the selected mapping of notes to group consecutive equivalent notes together within the selected mapping.

8. The method of claim 2, further comprising:

determining a reference tuning frequency for the audio recording.

9. The method of claim 2 further comprising a step of note segmentation conducted in a note segmentation and description component, the step of note segmentation including dynamic programming note segmentation by breaking down the audio recording into short notes from a fundamental frequency contour of the low-level features; the note segmentation performing iterative processes including note consolidation, with short notes from the note segmentation being consolidated into long notes; refining the tuning reference frequency; re-determining nominal fundamental frequency; deciding whether the note segmentation used for the note consolidation has changed as a result of the iterative process.

10. The method of claim 9, wherein in the step of the note segmentation upon deciding that the note segmentation has changed, the iterative process are repeated in the segmentation unit; upon deciding that the note segmentation has not changed the processing proceeds from the segmentation unit to the note descriptors unit, so as to determine the note descriptors for every identified note.

11. A computer program product tangibly embodied in at least one machine-readable media for use in connection with processing an audio recording, the computer program product comprising instructions that are executable. by at least one processing device, so as to carry out the following functions:

providing an input for determining or processing notes in an audio recording including receiving the audio recording at a note segmentation and description component;

processing the audio recording including extracting a set of low-level features or descriptors from the audio recoding in a low-level features extraction unit;

identifying and determining a sequence of notes in the audio recording in a segmentation unit;

associating each note in the sequence of notes with a set of the note descriptors in a note descriptors unit;

determining a rating for tuning of notes playing in the audio recording in a tuning rating unit;

determining an expression rating for the expression of the notes playing in the audio recording in an expression rating unit;

combining the tuning rating and the expression rating in a global rating unit, so as to determine a global rating for the notes playing in the audio recording;

determining a sequence of identified notes corresponding to the audio recording during each successive iterations over at least a portion of the audio recording, identifying potential notes with the portion of the audio recording; and providing an output for the audio recording.

12. The computer program product of claim 11, wherein the sequence of identified notes corresponding to the audio recording is determined substantially without using any pre-defined standardized version of the musical composition.

13. The computer program product of claim 11, wherein determining the sequence of identified notes comprises:

separating the audio recording into consecutive frames;

selecting a mapping of notes from one or more mappings of the potential notes corresponding to the consecutive frames, wherein each identified note has a duration of one or more frames of the consecutive frames.

14. The computer program product of claim 13, wherein selecting the mapping of notes comprises:

evaluating a likelihood of a potential note of the potential notes being notes based on at least one of a duration of the potential note, a variance in fundamental frequency of the potential note, or a stability of the potential note.

15. The computer program product of claim 11, wherein selecting the mapping of notes further comprises:

determining one or more likelihood functions for the one or more mappings of the potential notes, the one or more likelihood functions being based on the evaluated likelihood of potential notes in the one or more mappings of the potential notes; and selecting the likelihood function based on the relative values of the likelihood functions.

16. The computer program product of claim 13, further comprising instructions that are executable by at least one processing devices to:

consolidate the selected mapping of notes to group consecutive equivalent notes together within the selected mapping.

17. The computer program product of claim 11, further comprising instructions that are executable by at least one processing devices to:

determine a reference tuning frequency for the audio recording.

* * * * *